United States Patent [19]

Leonard et al.

[11] Patent Number: 4,964,457

[45] Date of Patent: Oct. 23, 1990

[54] UNIDIRECTIONAL HEAT PIPE AND WICK

[75] Inventors: John F. Leonard, Beavercreek; Brian G. Hager, Kettering, both of Ohio

[73] Assignee: The United States of America as represented by the Secretary of the Air Force, Washington, D.C.

[21] Appl. No.: 261,808

[22] Filed: Oct. 24, 1988

[51] Int. Cl.[5] ..... F28D 15/02

[52] U.S. Cl. ..... 165/32; 165/104.26; 165/905; 29/890.032

[58] Field of Search ..... 165/104.26, 32, 905

[56] References Cited

U.S. PATENT DOCUMENTS

| | | | |
|---|---|---|---|
| 3,613,774 | 10/1971 | Bliss, Jr. et al. | 165/32 |
| 3,700,028 | 10/1972 | Noren | 165/32 |
| 3,706,127 | 12/1972 | Oktay et al. | 165/905 |
| 3,754,594 | 8/1973 | Ferrell | 165/32 |
| 4,015,659 | 4/1977 | Schladitz | 165/104.26 |
| 4,060,126 | 11/1977 | Schladitz | 165/905 |
| 4,170,262 | 10/1979 | Marcus et al. | 165/104.26 |
| 4,366,857 | 1/1983 | Mayer | 165/104.23 |
| 4,673,030 | 6/1987 | Basiulis | 165/32 |
| 4,683,940 | 8/1987 | Ernst et al. | 165/32 |

OTHER PUBLICATIONS

Carbone, S. *Metallic Wick for a Heat Pipe* IBM Disclosure Bulletin, vol. 13, No. 9, 2/1971.

*Primary Examiner*—Albert W. Davis, Jr.
*Attorney, Agent, or Firm*—Fredric L. Sinder; Donald J. Singer

[57] ABSTRACT

A predominantly unidirectional wick primarily for use in unidirectional heat pipe wicks is disclosed. The wick is made by supporting magnetically susceptible particles on a wire screen and moving the screen inside a magnetic field until the characteristic cone or point shapes assumed by the particles are aligned in a laid down orientation. The particles are then heat treated to yield a sintered wick. An example of the disclosed wick made with nickel powder demonstrates improved wicking in the direction pointed to by the laid down points. The invention also includes a combination with the spinning pipe-slurry method for making heat pipe wicks. Magnetically susceptible powder is mixed into a viscous binder to make a slurry, then injected inside a rotating cylindrical heat pipe container. A magnetic field is created around the spinning container and varied to align the particles in a desired structure. The slurry is dried while still spinning to retain the desired structure and then heat treated to yield a sintered wick.

2 Claims, 2 Drawing Sheets

UNIDIRECTIONAL HEAT PIPE AND WICK

RIGHTS OF THE GOVERNMENT

The invention described herein may be manufactured and used by or for the Government of the United States for all governmental PurPoses without the payment of any royalty.

CROSS-REFERENCE TO RELATED APPLICATIONS

This application relates to five companion applications titled: A METHOD OF MANUFACTURING HEAT PIPE WICKS, U.S. application Ser. No. 07/261,809 now U.S. Pat. No. 4,885,129 (Air Force Docket Number AF18279); A METHOD OF MANUFACTURING HEAT PIPE WICKS AND ARTERIES. U.S. application Ser. No. 07/261,807 now U.S. Pat. No. 4,929,414 (Air Force Docket Number AF18278); ELECTRICAL BATTERY CELL WICKING STRUCTURE AND METHOD, U.S. application Ser. No. 07/261,804 pending (Air Force Docket Number AF18277A); RIGIDIZED POROUS MATERIAL AND METHOD, U.S. application Ser. No. 07/261,803 pending (Air Force Docket Number AF18277B); and, ALKALI AND HALOGEN RECHARGEABLE CELL WITH REACTANT RECOMBINATION, U.S. application Ser. No. 07/261,802 now U.S. Pat. No. 4,894,298 (Air Force Docket Number AF17953), all filed on the same date as this application and hereby incorporated by reference as if fully rewritten herein. Some of the applications have different named inventors and all of the applications are subject to an obligation of assignment to the Government of the United States as represented by the Secretary of the Air Force.

BACKGROUND OF THE INVENTION

The present invention relates generally to heat pipes, and more specifically to a novel predominantly unidirectional wick that is particularly suited for use in heat pipes.

Heat pipes use successive evaporation and condensation of a working fluid to transport thermal energy, or heat, from a heat source to a heat sink. Because most fluids have a high heat of vaporization, heat pipes can transport in a vaporized working fluid very large amounts of heat. Advantageously, the heat can be transported over very small temperature differences between the heat source and heat sink. Heat pipes generally use capillary forces through a porous wick to return condensed working fluid, or condensate, from a heat pipe condenser section (where transported thermal energy is given up to the heat sink) to an evaporator section (where the thermal energy to be transported is absorbed from the heat source).

Heat pipes generally transfer heat equally well in either direction. It is desired in many applications, however, that the flow of heat be restricted in one direction so that, for example, heat may be stored and not lost if the temperature of the intended heat source drops below the temperature of the intended heat sink. Alternatively, in many applications it is desired to remove harmful heat from equipment and to protect the equipment from absorbing heat if the temperature of the intended heat sink rises above the temperature of the equipment. These requirements are met by the use of unidirectional heat pipes which transfer heat preferentially in one direction.

Unidirectional heat pipes transfer heat preferentially in one direction by several methods. In some cases, they simply transfer heat at a higher flow rate in one direction than in the other. In other cases, they will transfer only a limited amount of heat in one direction before preventing further heat flow in that direction.

A common method, or approach, for making unidirectional heat pipes, sometimes called thermal diodes, is by so-called liquid flow control techniques using liquid traps and liquid blockages. When operated in reverse from its intended or normal direction, a liquid trap thermal diode "traps" the liquid working fluid in a compartment adjacent to the normally evaporator, now condenser, section so that the wick dries out and heat pipe operation ceases. A liquid blockage thermal diode stores excess liquid working fluid next to the normal condenser section. When operated in reverse from its normal direction, the excess liquid working fluid collects in the normally evaporator, now condenser, section, so that the excess liquid "blocks" normal operation of the heat pipe.

Another common approach for making unidirectional heat pipes, instead of controlling generally the liquid flow, controls by various methods the vapor flow.

A third approach for making unidirectional heat pipes uses the wick to control the movement of liquid working fluid. One example of this approach teaches using a dual section wick having a thicker wick with smaller pores in the evaporator section, and a thinner wick with larger pores in the condenser section. When operated in reverse, the thin wick-large pore, now evaporator, wick section quickly dries out and prevents further heat flow.

While using the wick structure to make heat pipes unidirectional provides advantages of simplicity and easy retrofit to high performance prior art heat pipe designs, prior art attempts to provide such wicks have largely produced wicks of complex structure, requiring complex fabrication techniques, that are generally as difficult to incorporate in a heat pipe application as more elaborate liquid and vapor flow methods.

Thus it is seen that there is a need for a method for making unidirectional wicks for heat pipes that have a simple structure and are straightforward to make.

It is, therefore, a principal object of the present invention to provide a method for making a predominantly unidirectional wick for heat pipes that has a simple structure and is straightforward to make.

It is another object of the invention to provide a structure and method for making an improved sintered metal wick structure of arbitrary shape that wicks fluid preferentially in one direction.

A feature of the present invention is that it is easy to fabricate within prior art heat pipes, particularly by using the spinning pipe method for making improved sintered metal heat pipe wicks taught in companion applications Ser. No. 07/261,809. A Method of Manufacturing Heat pipe Wicks, and Ser. No. 07/261,807. A Method of Manufacturing Heat pipe Wicks and Arteries.

SUMMARY OF THE INVENTION

The present invention provides a predominantly unidirectional wick for use in heat pipes and other wick applications. The unique discovery of the present invention is that typical powders used for making sintered metal heat pipe wicks can be first aligned in a magnetic field and laid down in a magnetic field defined pattern to create a unique structure which remains after sintering to make a predominantly unidirectional wick.

Accordingly, the present invention is directed to a method for making a sintered wick from magnetically susceptible particles comprising the steps of aligning the particles into a preselected structure by a magnetic field and sintering together the particles. The preselected structure may be laid down points.

The invention is additionally directed to a sintered particle wick made by aligning the particles into a preselected structure by a magnetic field before sintering. The preselected structure may be laid down points.

The invention is further directed to a method for making a wick comprising the steps of providing a supply of magnetically susceptible particles, providing a means for supporting the particles in a preselected wick outside shape, providing a magnetic field, placing the supporting means and supported particles inside the magnetic field, varying the magnetic field to align the particles into a preselected structure and heat treating the supported particles to yield a wick. The heat treating may be sintering.

The invention is also directed to a method for making a predominantly unidirectional heat pipe comprising the steps of providing a heat pipe container having an inside surface, providing a supply of magnetically susceptible particles, covering a part of the inside surface of the heat pipe container with said particles, providing a magnetic field, placing the heat pipe container and covering particles inside the magnetic field, varying the magnetic field to align the particles into a preselected structure and heat treating the supported particles to yield a wick. The heat treating may be sintering.

The invention is also directed to a method for making a predominantly unidirectional heat pipe comprising the steps of providing a heat pipe container having an inside surface, providing a slurry of magnetically susceptible particles suspended in a viscous binder, coating a part of the inside surface of the heat pipe container with the slurry, providing a magnetic field, placing the heat pipe container and slurry inside the magnetic field, rotating the container so that the slurry generally covers the inside surface of the container, while rotating the container, varying the magnetic field to align the particles into a preselected structure, while continuing to rotate the container, drying the slurry to form a green wick and heat treating the green wick to yield a final composition of the heat pipe wick. The heat treating may be sintering.

The invention also includes a method for making a predominantly unidirectional wick comprising the steps of providing a magnetic field, providing a support surface, providing a slurry of metal particles suspended in a viscous binder, coating at least part of the support surface with the slurry, placing the slurry coated support surface inside the magnetic field, varying the magnetic field to align the metal particles into a preselected structure and heat treating the slurry coated support surface to yield a unidirectional wick.

The invention also includes a method for making a heat pipe wick on an inside surface of a heat pipe container comprising the steps of providing a magnetic field, providing a slurry of magnetically susceptible particles suspended in a viscous binder, coating at least part of the inside surface of the container with the slurry, rotating the container inside the magnetic field so that the slurry generally covers the inside surface of the container, varying the magnetic field to align the particles into a preselected structure, while continuing to rotate the container inside the magnetic field, drying the slurry to form a green wick and heat treating the green wick to yield a final composition of the heat pipe wick.

DESCRIPTION OF THE DRAWINGS

The present invention will be more clearly understood from a reading of the following detailed description in conjunction with the accompanying drawings wherein.

DETAILED DESCRIPTION

Figure 1A:
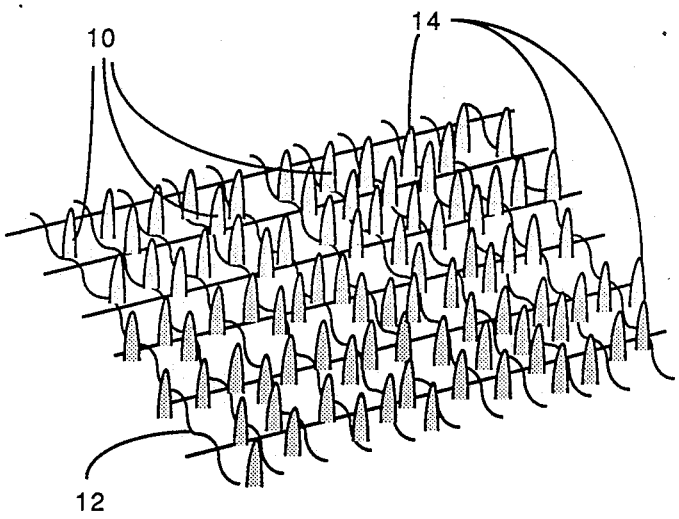
FIG. 1*a* is a generalized diagram of magnetically susceptible particles supported on a wire screen showing their alignment by a magnetic field.

Referring now to FIG. 1*a* of the drawings, there is shown a generalized diagram of magnetically susceptible particles 10 supported on a wire screen 12. The view is exaggerated for clarity. Screen 12 is placed inside a magnetic field, not shown, and moved back and forth to align particles 10 into the characteristic pointed or spiked cone-shaped points 14 shown in FIG. 1*a*. points 14 result from particles 10 attempting to align with the magnetic field lines and are familiar to those persons with experience with experiments with magnetic fields and magnetically susceptible particles such as iron filings.

Figure 1B:
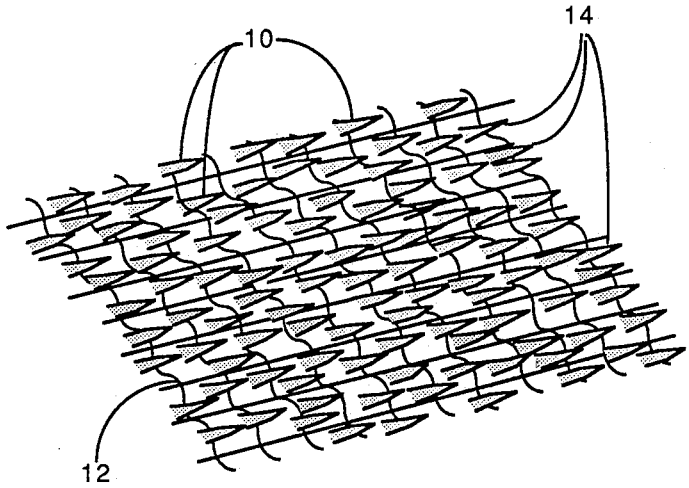
FIG. 1*b* is a generalized diagram of the particles of FIG. 1*a* aligned in a laid down position by the magnetic field according to the teachings of the present invention; and, FIG. 2 is a microphotograph of a flat sample of sintered wick material made according to the teachings of the present invention.

FIG. 1*b* shows particles 10 and points 14 magnetically aligned in a laid down position. To achieve this structure, support screen 12 is moved back and forth within the magnetic field, the field varied around screen 12, or a combination of both, until points 14 assume the desired laid down orientation.

Figure 2:
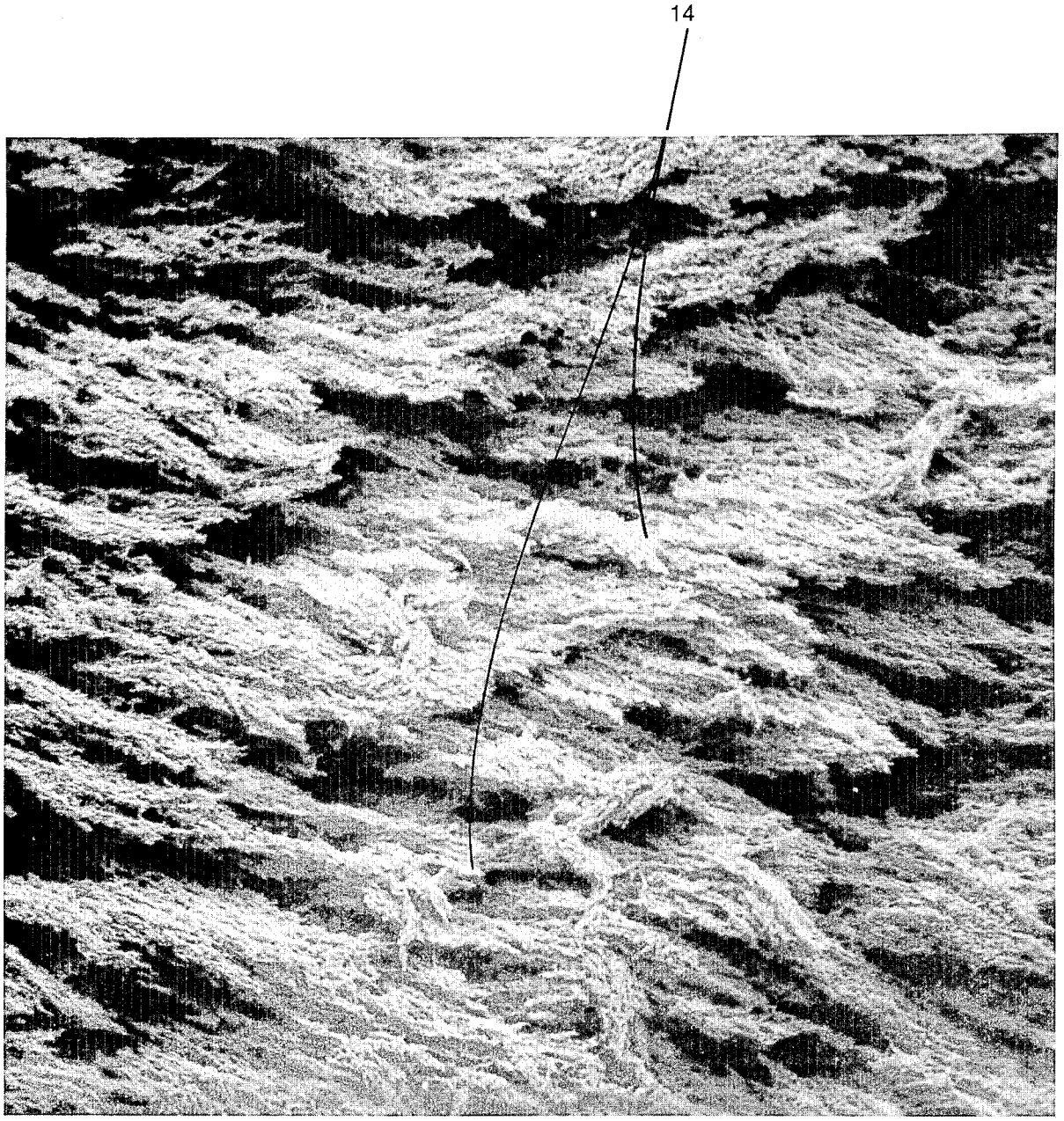

FIG. 2 is a microphotograph of a wick sample made by the method of FIG. 1*b*. Nickel powder, 3 to 5 microns, was spread evenly over a wire screen. The screen and powder were then passed through a magnetic field numerous times to orient the particles in the shown desired direction. The screen and oriented powder were then placed inside a sintering oven and the oven temperature allowed to rise to 1000° C. and held for approximately 15 minutes to sinter together the nickel powder particles. Inspection of FIGS. 1 and 2 shows that each cone or point 14 has a base and an apex, with the bases substantially attached to wire screen, or substrate, 12 and the apexes all pointing substantially in the same direction, to the right of the figures.

Wicking tests performed on the wick material of FIG. 2 demonstrate that the material wicks preferentially in the direction pointed to by the cones or points. Curiously, the wick will initially wick liquid more rapidly in the direction opposite to the point orientation, but the wicking action ends after a limited length while wicking in a direction with the point orientation continues for an extended distance. Using the disclosed wick material in a heat pipe that is longer than the distance the wick material will normally wick a selected working fluid in its reverse direction will produce a predominantly unidirectional heat pipe.

It will be seen by those with skill in the art of the invention that combining with the disclosed wick teaching of magnetically orienting particles before sintering the spinning pipe-slurry method of companion applications Ser. No.07/261,809 and 07/261,807 will provide a greatly improved heat pipe having unidirectional properties. To perform the invention as a combination with the spinning pipe method of making heat pipe wicks merely requires applying an aligning magnetic field during the spinning process. The viscous binder will not prevent the slurry particles from orienting themselves in response to the magnetic field, but will generally require continuously maintaining the magnetic field while forming the green wick. Those with skill in the art will find that routine experimentation and analysis will provide a great variety of techniques for creating and varying the required magnetic field. The spinning heat pipe container will produce its own induced magnetic field, through its interaction with the primary magnetic field, so that the actual particle orienting field will, at least initially, generally be more the result of experimentation than analysis. Fortunately, the desired orientation of the particles is easily inspected visually so that experimentation will be routine.

The disclosed method for making a predominantly unidirectional heat pipe and wick successfully demonstrates using a magnetic field to pre-align the particles of a sintered heat pipe wick into a desired shape and structure having improved wicking characteristics. Though the disclosed use is specialized, it will find application in other areas where the structure, especially the microstructure, of a material significantly affects its physical properties and the material can be affected by magnetic or other fields.

It will be seen by those with skill in the art that other structures, which may be created by using a magnetic field, than the particular disclosed structure may have physical properties different from the disclosed wicking unidirectionality, but which are equally useful. The invention is understood, therefore, not to be limited to the disclosed laid down points structure.

It is understood that other modifications to the invention as described may be made, as might occur to one with skill in the field of the invention, within the intended scope of the claims. Therefore, all embodiments contemplated have not been shown in complete detail. Other embodiments may be developed without departing from the spirit of the invention or from the scope of the claims.

We claim:

1. A wick, comprising particles sintered together, over a substrate, in the shape of a plurality of overlapping laid down points, each point comprising a plurality of particles and having a base and an apex, wherein the points are aligned at acute angles to the substrate with their bases substantially attached to the substrate and their apexes all pointing substantially in the same direction.

2. The wick according to claim 1, wherein the particles and points are magnetically aligned.

* * * * *